US010280646B2

(12) United States Patent
McLennan

(10) Patent No.: US 10,280,646 B2
(45) Date of Patent: May 7, 2019

(54) PICK-RESISTANT PIN TUMBLER LOCK

(71) Applicant: Spencer Purves McLennan, Vancouver (CA)

(72) Inventor: Spencer Purves McLennan, Vancouver (CA)

(73) Assignee: Iris Business Intelligence Inc., Vancouver (CA)

( * ) Notice: Subject to any disclaimer, the term of this patent is extended or adjusted under 35 U.S.C. 154(b) by 0 days.

(21) Appl. No.: 15/430,487

(22) Filed: Feb. 12, 2017

(65) Prior Publication Data

US 2017/0234035 A1 Aug. 17, 2017

Related U.S. Application Data

(60) Provisional application No. 62/294,127, filed on Feb. 11, 2016.

(51) Int. Cl.
*E05B 27/00* (2006.01)

(52) U.S. Cl.
CPC ..... *E05B 27/0057* (2013.01); *E05B 27/0071* (2013.01)

(58) Field of Classification Search
CPC ..... E05B 27/0057; E05B 27/0003; E05B 27/0014; E05B 27/0046; E05B 27/0071; E05B 27/0075; E05B 2027/0025; E05B 27/0082; E05B 29/0066; E05B 29/0053
USPC ..... 70/360, 361, 378, 419, 421, 491, 70/493–496, 420, 416, 492, 391, DIG. 2, 70/DIG. 15, DIG. 22, DIG. 23, DIG. 25, 70/DIG. 29
See application file for complete search history.

(56) References Cited

U.S. PATENT DOCUMENTS 1,009,155 A * 11/1911 Resch ..... E05B 27/0053 70/340
1,050,692 A * 1/1913 Kohlberger ..... E05B 65/0864 292/DIG. 37
1,929,658 A * 10/1933 Solliday ..... E05B 17/04 70/156
2,021,185 A * 11/1935 Hurd ..... E05B 27/0082 70/419
2,227,791 A * 1/1941 Moses ..... E05B 27/0067 70/421
2,287,175 A * 6/1942 Heyer ..... E05B 27/0082 70/421
2,295,737 A * 9/1942 Johnstone ..... E05B 27/0082 70/419
2,313,711 A * 3/1943 Jacobi ..... E05B 83/30 292/DIG. 37
2,391,832 A * 12/1945 Johnstone ..... E05B 9/084 70/367
2,683,978 A * 7/1954 Jacobi ..... E05B 1/0038 292/336.3
2,712,749 A * 7/1955 Quigley ..... E05B 17/04 70/129
2,831,338 A * 4/1958 Spain ..... E05B 27/0082 70/419

(Continued)

*Primary Examiner* — Lloyd A Gall

(57) ABSTRACT

A pick-resistant pin tumbler lock having a first stage in which the pins may move but the plug cannot rotate, and a second stage in which the plug may rotate but the pins cannot move. Pin movement inhibitors prevent further movement of the pins once sufficient rearward force is applied to the lock, and a rotation inhibitor prevents rotation of the plug until after the sufficient rearward force is applied.

23 Claims, 7 Drawing Sheets

(56) References Cited

U.S. PATENT DOCUMENTS 2,837,908 A * 6/1958 Segal ..... E05B 9/086 70/367
3,025,695 A * 3/1962 Smogar ..... E05B 29/00 70/360
3,059,462 A * 10/1962 Check ..... E05B 27/005 70/384
3,455,128 A * 7/1969 Emil ..... E05B 27/00 70/361
3,605,463 A * 9/1971 Epstein ..... E05B 27/0082 70/378
3,837,197 A * 9/1974 Lopez ..... E05B 27/0039 70/378
3,910,082 A * 10/1975 Patriquin ..... E05B 1/0038 70/360
4,254,648 A * 3/1981 Dietrich ..... E05B 11/00 70/380
4,377,940 A * 3/1983 Hucknall ..... E05B 15/1614 70/378
RE31,910 E * 6/1985 Oliver ..... E05B 9/086 70/369
4,712,398 A * 12/1987 Clarkson ..... E05B 47/063 361/172
4,712,399 A * 12/1987 Mattossovich ..... E05B 27/005 70/495
4,723,427 A * 2/1988 Oliver ..... E05B 27/0082 70/366
4,848,115 A * 7/1989 Clarkson ..... E05B 47/063 361/172
4,977,767 A * 12/1990 Prunbauer ..... E05B 27/0082 70/406
5,209,087 A * 5/1993 Cox ..... E05B 9/086 70/369
5,375,444 A * 12/1994 Smith ..... E05B 27/0053 70/337
5,799,520 A * 9/1998 Laabs ..... E05B 13/105 200/318.2
6,389,857 B1 * 5/2002 Meekma ..... B60R 25/0225 70/209
6,474,122 B2 * 11/2002 Davis ..... E05B 17/2092 70/278.3
6,718,807 B2 * 4/2004 Andersson ..... E05B 9/086 70/369
6,826,936 B1 * 12/2004 Ming-Er ..... E05B 29/0013 70/353
7,357,010 B1 * 4/2008 Huang ..... E05B 17/04 70/379 R
7,574,883 B2 * 8/2009 Grampurohit ..... E05B 27/0039 70/378
7,596,975 B1 * 10/2009 Yuan ..... E05B 9/08 70/134
7,681,425 B2 * 3/2010 Teixeira ..... E05B 17/16 70/367
7,716,958 B2 * 5/2010 Martin ..... E05B 9/04 70/367
7,775,074 B1 * 8/2010 Tobias ..... E05B 27/0017 70/493
8,056,379 B2 * 11/2011 Dickhans ..... E05B 27/005 70/371
8,096,155 B2 * 1/2012 Williams ..... E05B 27/00 70/358
8,186,194 B2 * 5/2012 Field ..... E05B 27/0035 70/409
8,490,446 B2 * 7/2013 Rao ..... E05B 27/0035 70/338
8,720,238 B1 * 5/2014 Davis ..... E05B 43/005 70/278.7
8,720,241 B1 * 5/2014 Widen ..... E05B 27/0082 70/495
8,806,908 B2 * 8/2014 Yu ..... E05B 27/0007 109/59 T
9,416,561 B2 * 8/2016 Field ..... E05B 19/0064
10,047,540 B2 * 8/2018 Charnley ..... E05B 47/0044
2005/0097933 A1 * 5/2005 Ruan ..... E05B 9/086 70/493
2005/0217330 A1 * 10/2005 Chong ..... E05B 29/004 70/492
2006/0096344 A1 * 5/2006 Lee ..... E05B 27/0032 70/491
2008/0271506 A1 * 11/2008 Grampurohit ..... E05B 27/0039 70/358
2010/0326150 A1 * 12/2010 Chung ..... E05B 27/0039 70/491
2011/0271724 A1 * 11/2011 Huang ..... E05B 27/00 70/493
2012/0304716 A1 * 12/2012 Loreti ..... E05B 17/0045 70/492

* cited by examiner

PICK-RESISTANT PIN TUMBLER LOCK

FIELD OF THE INVENTION

This invention relates to mechanical locking mechanisms. In particular, this invention relates to a pick-resistant pin tumbler lock.

BACKGROUND OF THE INVENTION

Pin tumbler locks comprise a housing carrying a cylindrical plug. Rotation of the plug within the housing activates the cam mechanism by which a locking bolt is manipulated, unlocking the lock. The plug has a series of holes, each to accommodate a spring-loaded pin having top (driver pin) and bottom (key pin) portions of varying length. When the pins are correctly positioned by inserting the correct key in the keyway, the top portions of all of the pins are in the housing and the lower portions are in the plug, aligning the gap between them with the shear line and allowing the plug to rotate in the housing along the shear line. In theory, the plug rotates only when the correct key is inserted; otherwise the bodies of the pins physically prevent such rotation by blocking the shear line.

However, pin tumbler locks have a major flaw that makes them vulnerable to picking: they allow a user to move the pins and spin the plug at the same time, even without the proper key. If the user is able to spin the plug enough, for example using a tension wrench, it can create a ledge upon which the driver pins can be rested. That is, each pin can be manipulated to move its top portion above the shear line and to rest it on the ledge, while the lower portions move into the plug. Once all of the pins are out of the way of the shear line, the lock is picked.

Bumping is another way in which pin tumbler locks may be opened without the correct key. This technique requires a bump key to be inserted into the keyway. The bump key is then tapped lightly, briefly separating the key and driver pins so the driver pins are all above the shear line. This allows the plug to rotate, if the user turns the key quickly while the pins are still out of the way.

Earlier lock designs have tried to make picking more difficult by creating things like mushroomed pins and multiple sets of pins. For example, U.S. Pat. No. 6,584,819 discloses a lock having two sets of pins, each operated by a different area of the same key. The key must be inserted and then rotated to ensure that both a flat portion of the key and a cylindrical portion of the key connect with the appropriate areas of the lock body. International Pub. No. WO 91/14064 discloses a cylinder lock in which each pin is divided into at least four pieces, providing two shear gaps, each of which must be properly aligned before the cylinder will rotate. However, such designs generally fail to properly address the root shortcoming with pin tumbler locks, namely the ability to spin the plug and move the pins simultaneously. U.S. Pat. No. 2,281,714 discloses an anti-bumping lock comprising a resilient layer around the pins, such that they are not easily moved except along a perfectly straight axis, i.e. by insertion of the proper key, which may be difficult to manufacture and to maintain.

Other lock designs have tried to secure the lock through additional mechanisms such as a secondary protrusion from the core into the housing, preventing the lock core from rotating until that protrusion is retracted, generally by insertion of a correctly cut key. For example, DE 102010 035809 discloses a secondary mechanism comprising balls that abut a recess in the inner housing of the lock, such that the lock core cannot rotate unless the correct key moves a shear pin out of the way, allowing the balls to move away from the housing. DE 10208893, U.S. Pat. Nos. 1,965,889, 3,837,197, 6,481,255, 9,435,138 and 9,482,031, and many others comprise one or more locking bars that interact with the housing and prevents cylinder movement until they are properly retracted. U.S. Pat. No. 5,488,847 comprises a pawl that can only be moved out of the way by a first rotation of the key, followed by a rapid rotation of the key in the opposite direction. However, these additional mechanisms generally complicate the overall design and manufacture of the lock, and still fail to address the primary shortcomings.

Still other lock designs have several interacting pins, plates or other components within the lock core to increase the difficulty of picking the lock. Examples of these types of locks include GB 2266918, U.S. Pat. Nos. 6,481,255 and 6,584,819 and U.S. Pub. No. 2006/0230797. However, these designs require specially shaped keys which are difficult and costly both to manufacture and to replace if lost. In addition, the inner workings of the lock are often extremely complex and require precision machining, making the lock difficult and expensive to manufacture to required standards.

It is therefore an object of this invention to provide a pick-resistant lock that overcomes the foregoing deficiencies.

It is a further object of the invention to provide a pick-resistant lock that restricts the rotational movement of the plug while the pins are able to be moved.

It is a further object of the invention to provide a pick-resistant lock that restricts movement of the pins while the plug is able to be rotated.

These and other objects of the invention will be better understood by reference to the detailed description of the preferred embodiment which follows. Note that the objects referred to above are statements of what motivated the invention rather than promises. Not all of the objects are necessarily met by all embodiments of the invention described below or by the invention defined by each of the claims.

SUMMARY OF THE INVENTION

This invention eliminates the ability of a user to ledge pins as required to pick a lock. That is, it eliminates a user's ability to spin the plug slightly, creating a ledge, and move pins vertically to allow their top portions to sit upon the ledge while their lower portions fall down into the plug. It further eliminates the ability to spin the plug quickly, while the pins are separated, after the lock is bumped.

The invention does this by separating the ability to spin the plug and to move the pins into two stages. In the first stage, which is the resting stage of the lock, a user may move the pins but not spin the plug. In the second stage, accessed by pushing the plug away from the lock face, a user may attempt to spin the plug but may not move the pins. The lock is provided with a mechanism to prevent rotation of the plug in the first stage, and a mechanism to prevent movement of the pins in the second stage. The lock will thus only open if the pins are first moved into the correct positions, i.e. with the correctly cut key, and then the user exerts sufficient rearward force on the lock to allow the plug to spin. Unless both conditions are satisfied, the key will not open the lock.

In a first aspect, the invention comprises a pick-resistant pin tumbler lock having a cylinder; a plug within said cylinder; a plurality of pins extending between said cylinder and said plug; at least one pin movement inhibitor, adapted to contact and prevent movement of at least one of said pins;

and a plug rotation inhibitor adapted to prevent said plug from rotating within said cylinder. A plug container may be provided within the cylinder to hold the plug, in which case the pins would extend between the plug container and the plug.

In a further aspect, the pin movement inhibitor may comprise an elongated member having a longitudinal axis parallel to a longitudinal axis of the plug. The elongated member may be axially compressible and circumferentially expandable under a rearward force applied to the lock, which expansion causes the elongated member to contact the at least one pin.

In another aspect, the pin movement inhibitor may comprise a plurality of abutting pin movement inhibitors, each of which transversely contacts at least one of the pins when a rearward force is applied to the lock. The abutting pin movement inhibitors may pass from the cylinder through apertures in the plug in order to contact the pins.

In a further aspect, the plug rotation inhibitor may be engaged at least partially with said cylinder, to prevent said plug from rotating within said cylinder unless said plug rotation inhibitor is disengaged from said cylinder. The disengagement may be caused by application of a rearward force to said plug. Alternatively or in addition, the cylinder may be insertable within a borehole holding the lock and said plug rotation inhibitor may be engaged at least partially with a recess in said borehole to prevent said plug from rotating within said cylinder unless said plug rotation inhibitor is disengaged from said recess.

In yet a further aspect, the plug rotation inhibitor may comprise an extension on a plug cap attached permanently or removably to a rear portion of the plug. In the removable embodiment, a retainer pin may be provided on the rear face of the plug, wherein the retainer pin engages with the plug cap to provide coordinated rotation of the plug cap and the plug and ensure that the plug cap does not rotate separately from the plug.

In a further aspect, the lock may comprise a plug container between the plug and the cylinder, wherein the plug container comprises apertures to accommodate the pins.

In another aspect, the lock may comprise a compression device to bias the plug rotation inhibitor towards the recess. The compression device may comprise at least one elongated member which extends into the plug under a rearward force applied to the plug, to axially compress and circumferentially expand the pin movement inhibitor, which expansion causes the pin movement inhibitor to contact the at least one pin.

The foregoing may cover only some of the aspects of the invention. Other aspects of the invention may be appreciated by reference to the following description of at least one preferred mode for carrying out the invention in terms of one or more examples. The following mode(s) for carrying out the invention is not a definition of the invention itself, but is only an example that embodies the inventive features of the invention.

BRIEF DESCRIPTION OF THE DRAWINGS

At least one mode for carrying out the invention in terms of one or more examples will be described by reference to the drawings thereof in which.

Figure 1:
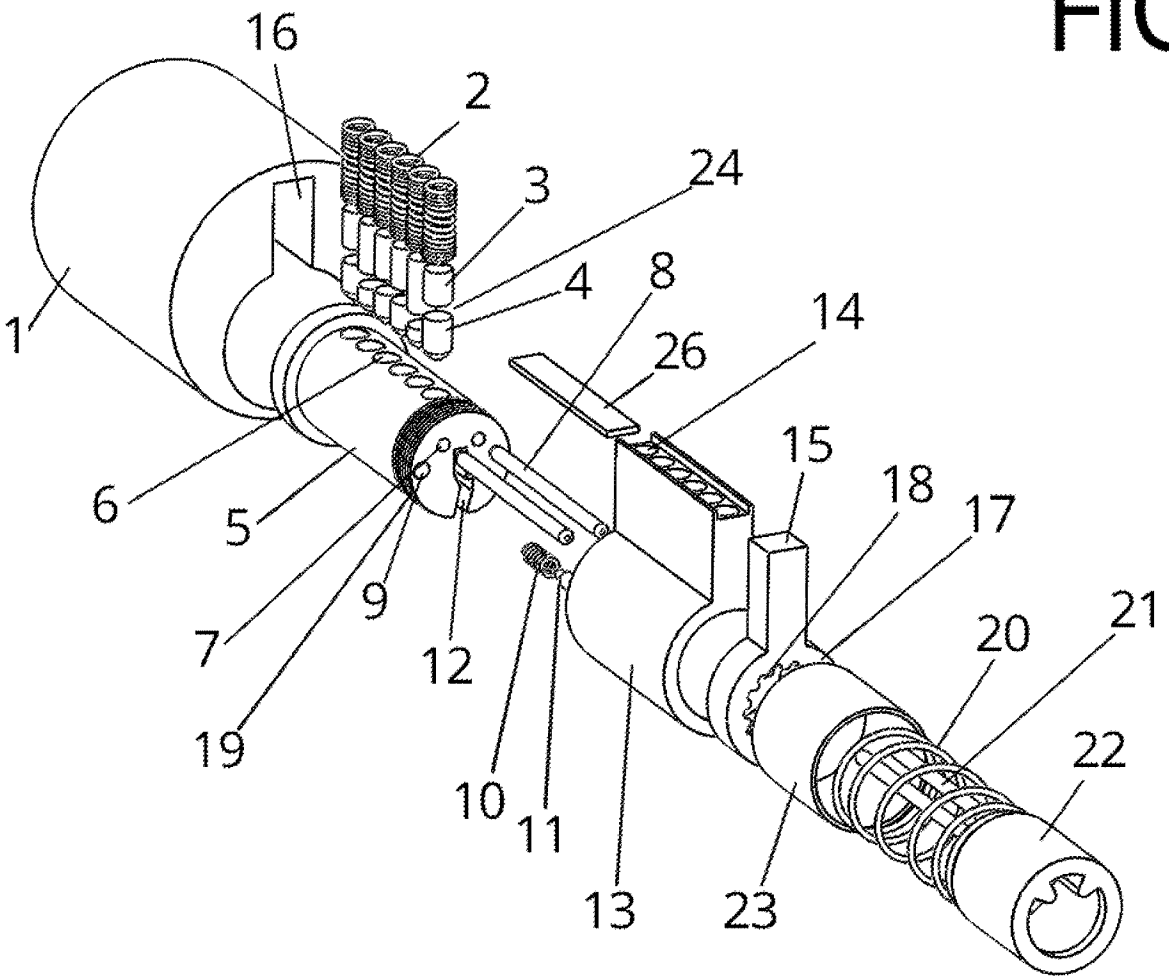
FIG. 1 is an exploded perspective view, showing the lock of the invention.
Figure 2:
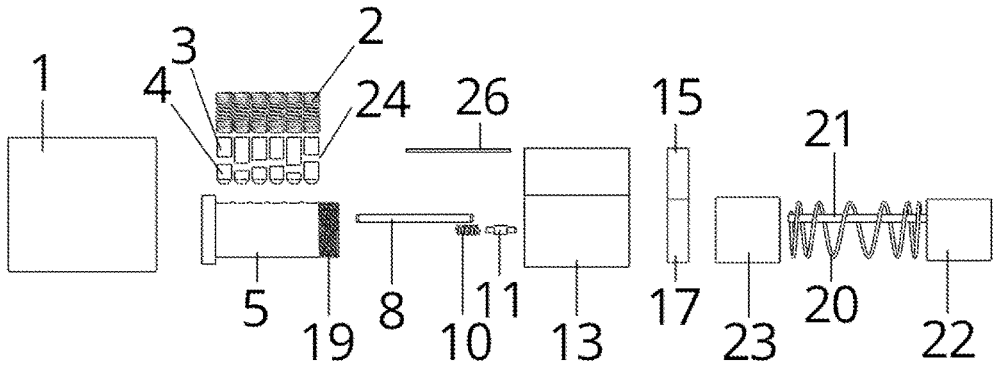
FIG. 2 is an exploded side view of the lock.
Figure 3:
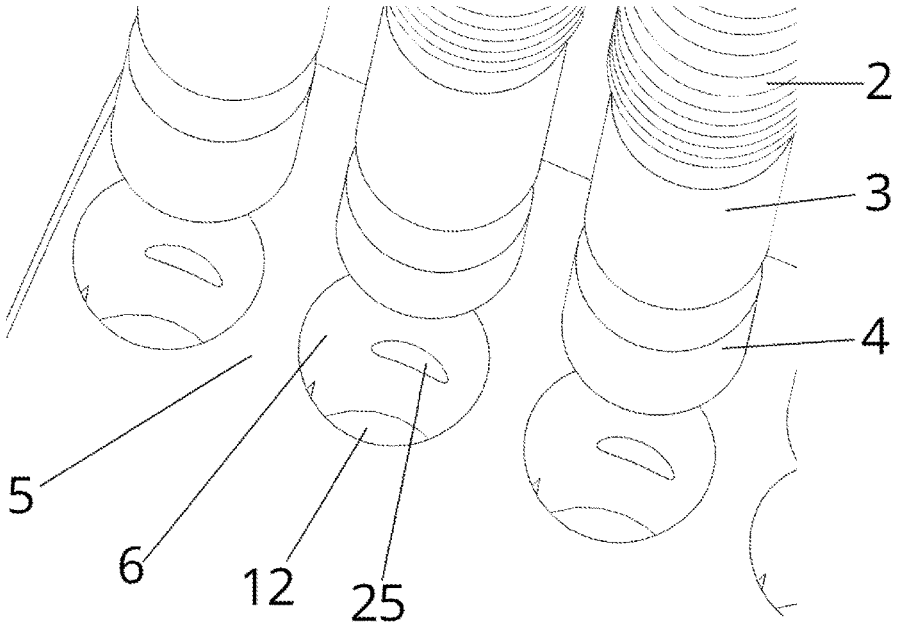
FIG. 3 is an enlarged exploded view of a portion of the lock.

DETAILED DESCRIPTION OF AT LEAST ONE MODE FOR CARRYING OUT THE INVENTION IN TERMS OF EXAMPLE(S)

Referring to FIGS. 1-7, the lock of the invention comprises several components that are common in basic pin tumbler locks, including a cylinder 1 and a plurality of pin springs 2, pin drivers 3 and key pins 4, which are collectively referred to herein as "pins". The cylinder 1, which is typically cylindrical in shape but may be of any suitable shape such as cubic, cuboid or rhomboid, is insertable in a borehole (not shown) provided for it. A plug 5 fits wholly or partially within the cylinder 1. Plug 5 includes one or more pin apertures 6, each corresponding to a pin. Pin springs 2 each serve to bias a pin driver 3 and a key pin 4 into a pin aperture 6. Plug 5 comprises a keyway 12 to accommodate a user's key when the lock is properly opened. Plug 5 may be separated from the cylinder 1 by a plug container 13. Plug container 13 includes an extension having channels 14 corresponding to the pins. Cap 26 covers the channel openings and retains the pin springs 2.

As it will be used herein, "rear" will be understood to mean the face or end of a lock component that is away from the facing portion of the lock (i.e. the face that appears to a user inserting a key into the keyhole; the keyhole, which is not shown, leads from the front of the lock rearward into keyway 12).

In one embodiment, the rear face of plug 5 comprises a retainer pin hole 9, sized to accommodate a retainer pin spring 10, which cradles a retainer pin 11, the purpose of which will be explained later. Plug 5 further comprises at least one expanding inhibitor aperture 7 in its rear face. Expanding inhibitor apertures 7 are drilled in the plug in such a manner that they slightly intersect with the pin apertures 6, such as at intersection 25 (shown only in FIG. 3).

One or more expanding pin movement inhibitors 8 are provided to correspond with expanding inhibitor apertures 7. Expanding pin movement inhibitors 8 are designed to expand in width along at least a portion of their length, when an axial force is applied to compress their length. They may be made out of any suitable material or combination of materials, and of any suitable configuration, as long as they are sufficiently reactive to the applied axial force. For example, the expanding pin movement inhibitors 8 may be made out of rubber or silicone or similar strong but deformable material. They may be rod-shaped, as shown, or they may be another mechanical device which expands in width when compressed in length.

The lock also comprises a compression device, which comprises a compression spring 20, one or more plungers 21, and front 23 and rear 22 containers. The compression device serves to apply an axial force to compress the expanding pin movement inhibitors 8. When the plug 5 and plug container 13 are pushed towards the rear of the lock by a user inserting a key into the keyway 12, and subsequently pushing the fully-inserted key towards the rear, the front container 23 moves backward. Because the rear container 22 is axially stationary (although it may be rotatable, as will be discussed), the compression spring 20 is compressed between the front 23 and rear 22 containers. The plungers 21 are preferably affixed to the rear container 22 and therefore are also stationary. As the plug 5 moves closer, plungers 21 enter expanding inhibitor apertures 7, compressing the expanding pin movement inhibitors 8 lengthwise and causing them to expand in width, pressing into intersection 25 and against one or more pin drivers 3 and/or key pins 4, physically binding the pins and preventing them from moving vertically. Preferably the expanding inhibitor apertures 7 are positioned to allow the expanding pin movement inhibitors 8 to simultaneously bind both halves, i.e. pin drivers 3 and key pins 4, of one or more of the pins, such that if the shear gaps 24 do not line up with the outer surface of plug 5, the plug 5 cannot rotate. However, the expanding inhibitor apertures may be located to bind only one half of some or all of the pins, as long as the requirement that one or more of the bound pins blocks the shear gap 24.

When the correct key is inserted into keyway 12, and the key is pushed toward the rear of the lock, freeing plug rotation inhibitor 15 from cylinder recess inhibitor 16, and then the key is turned, plug 5 will rotate, causing expanding inhibitor apertures 7 to also rotate. Because plungers 21 are preferably always at least partially engaged with expanding inhibitor apertures 7, plungers 21 must also be able to rotate. There are several configurations that allow them to move as required. In one embodiment, the plungers 21 may be affixed permanently to the rear container 22. This of course requires that the compression device rear container 22 also be free to rotate. In another embodiment, the plungers 21 may be affixed to a circular piece of metal, which is itself free to rotate within the compression device rear container 22.

In the preferred embodiment, the cylinder 1 is preferably slightly longer than a typical cylinder. Normally, the cylinder would merely be approximately long enough to accommodate the length of the plug 5 and plug container 13, but in the invention, the additional cylinder length provides room to also accommodate a plug cap 17, which abuts the rear end of plug container 13, within the body of the cylinder 1. Plug cap 17 is generally circular and may be permanently attached to the rear end of plug 5, or may be removably attached by any suitable means, such as threads 19. In an embodiment having a removably attached plug cap 17, unwanted rotation of plug cap 17 may be an issue. Retainer pin 11 may be provided, which rests in retainer pin hole 9, and is biased by retainer pin spring 10 into engagement with one of the retainer pin notches 18. When retainer pin 11 is engaged with a retainer pin notch 18, plug cap 17 rotates along with the plug 5 only and does not spin freely around the plug threads 19. Retainer pin 11 may be of any suitable configuration, and in the embodiment shown comprises a wider diameter about its middle portion, and a smaller diameter at either end. This configuration allows one end of the retainer pin 11 to fit inside the retainer pin spring 10 and the other end to wedge into the retainer pin notch 18 without the retainer pin 11 sliding through either the retainer pin spring 10 or the retainer pin notch 18. It will be understood that in an embodiment wherein plug cap 17 is permanently attached to plug 5, the retainer pin may be omitted.

Figure 4:
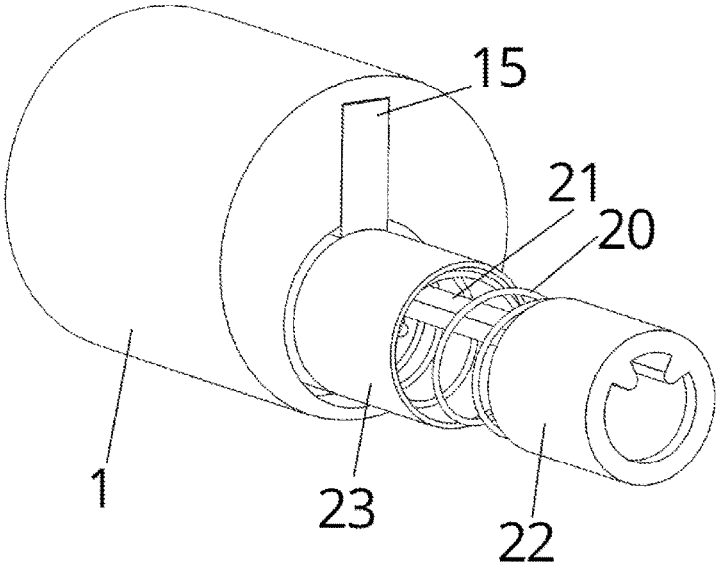
FIG. 4 is a perspective view of the back of the lock in a first position in which rotational plug movement is restricted.
Figure 5:
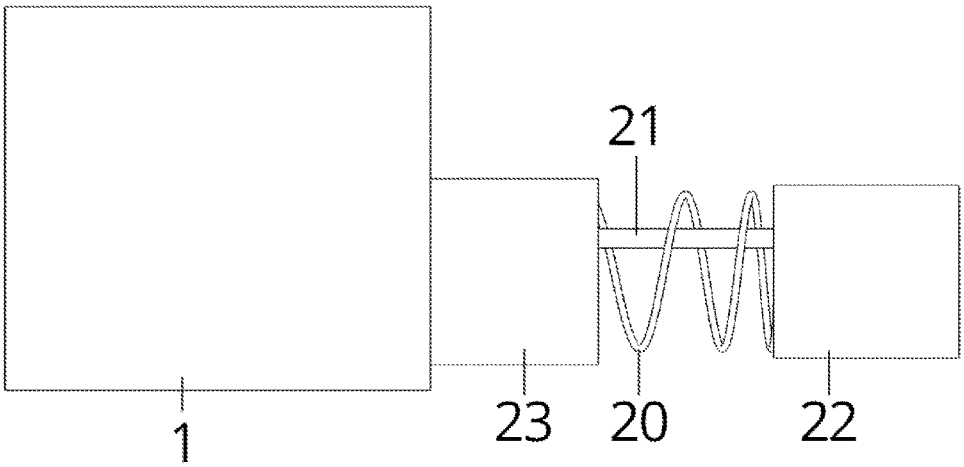
FIG. 5 is a side view of the lock in the first position.
Figure 6:
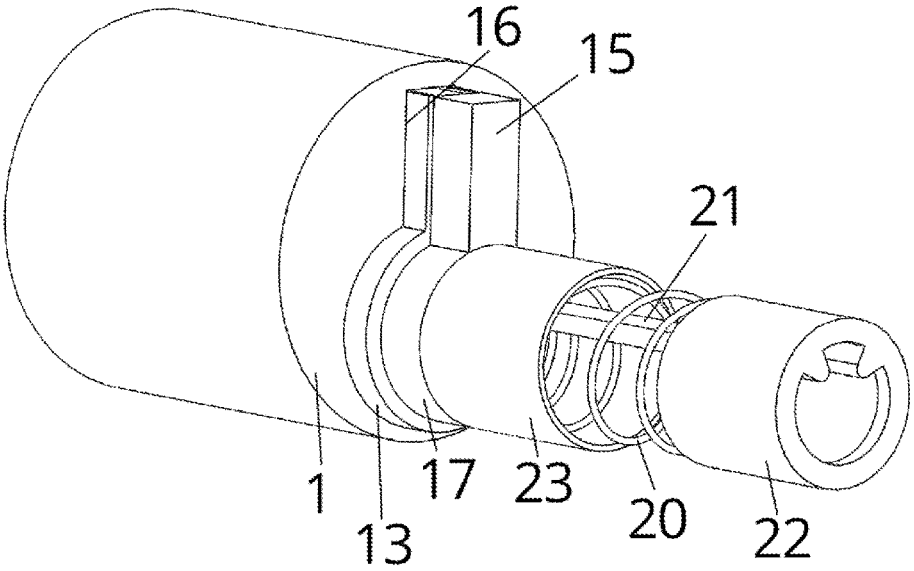
FIG. 6 is a perspective view of the lock in a second position in which rotational plug movement is not restricted.
Figure 7:
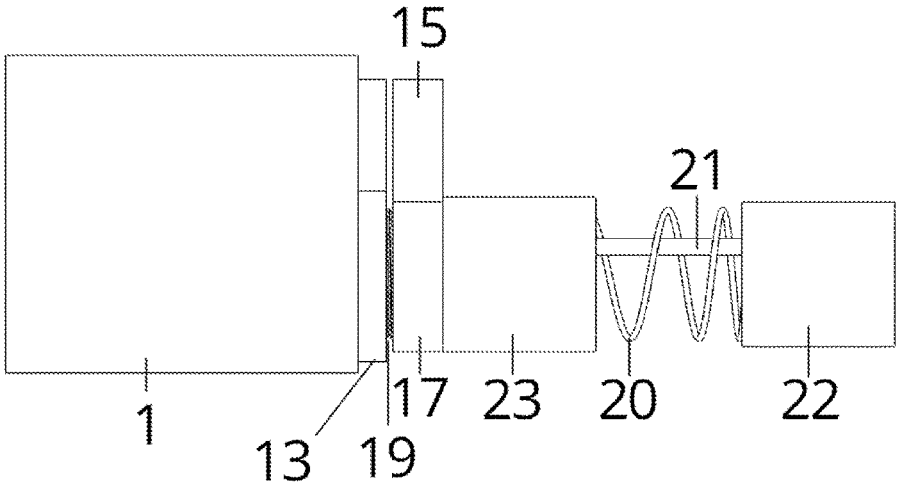
FIG. 7 is a side view of the lock in the second position.
Figure 8:
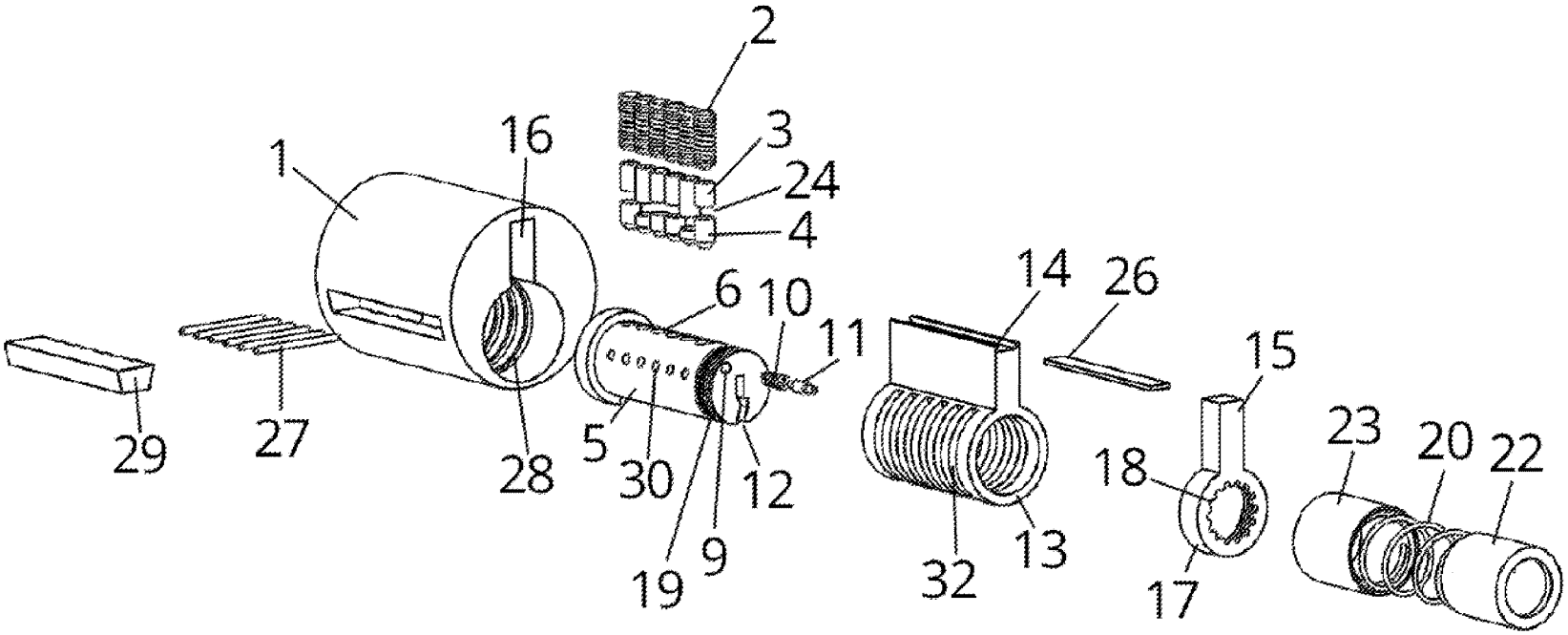
FIG. 8 is an exploded perspective view of an alternate embodiment of the lock.

Cylinder 1 is preferably provided with a recess 16 that snugly accommodates plug container 13, as well as plug cap 17, which is provided with an extended piece, shown as plug rotation inhibitor 15. In the embodiment shown, the recess 16 is a tubular bore in the cylinder, with a rectangular extension. The recess 16 is preferably shaped to generally correspond to the shape of plug cap 17 and plug rotation inhibitor 15, but may be a different shape, although in any case recess 16 must be large enough and properly shaped to snugly accommodate all or a portion of plug rotation inhibitor 15, as best shown in FIGS. 4 and 5. The function of the recess 16 is to accommodate the plug cap 17, preventing the plug from rotating unless the plug cap 17 is pushed rearwards and free from the constraints of cylinder 1, as best shown in FIGS. 6 and 7. In another embodiment, the recess 16 may be wholly or partially within the cylinder, and a secondary recess (not shown), sized to allow the required degree of movement of the plug rotation inhibitor 15, may be provided behind the recess 16.

The rectangular extension of recess 16 is shown as having sides that are approximately at a 90 degree angle to the rear face of the cylinder 1. Alternatively, the angle between the recess sides and the cylinder may be increased, which could allow the plug rotation inhibitor 15 to more easily find its way back into the recess 16, in turn making it easier for the user of the lock to remove a key from the keyway 12.

The compression device regulates the position of the lock and assists a user in resetting the lock to a position in which the key can easily be removed from the lock. The constant pressure provided by compression spring 20 is exerted against plug cap 17, and thereby against the plug 5, pushing the plug container 13 back into cylinder 1 if the user stops exerting an opposite force on the key, as long as the plug rotation inhibitor 15 is lined up with the recess 16 in the cylinder 1, as shown in FIG. 4.

In operation, the lock works as follows. The user inserts a key into keyway 12, moving all of the pin drivers 3 and key pins 4 to the proper levels, which would ordinarily allow plug 5 to rotate. However, the plug rotation inhibitor 15 is still fitted within recess 16, and the plug therefore is prevented from rotating until a sufficient rearward force is applied to move the plug 5 enough that the attached plug cap 17 and plug rotation inhibitor 15 are disengaged from recess 16. If either of these actions does not happen, the lock will not open. For example, if the pins 3, 4 are not quite at the right levels, when the expanding pin movement inhibitors 8 extend into pin apertures 6, they will bind at least some of the pins 3, 4 and prevent them from moving up or down. The space between the plug 5 and plug container 13 is therefore blocked by at least one of the pins and the plug will not rotate, even as sufficient rearward force is applied to free the plug cap 17 and plug rotation inhibitor 15. Further, the plug cannot be spun slightly unless the plug cap 17 and plug rotation inhibitor 15 are disengaged from recess 16, which makes it extremely difficult or even impossible to create a ledge on plug 5 with which to separate the driver pins 3 from the key pins 4 such that shear gap 24 is aligned with the space between the plug 5 and plug container 13. Again, the lock is prevented from rotating.

Figure 9:
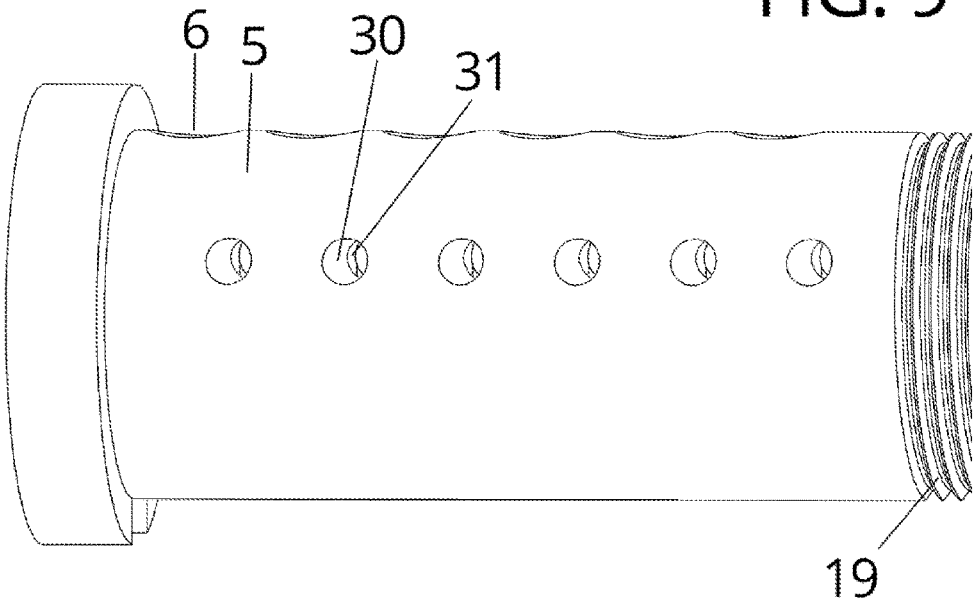
FIG. 9 is an enlarged exploded view of a portion of the lock in the embodiment shown in FIG. 8.
Figure 10:
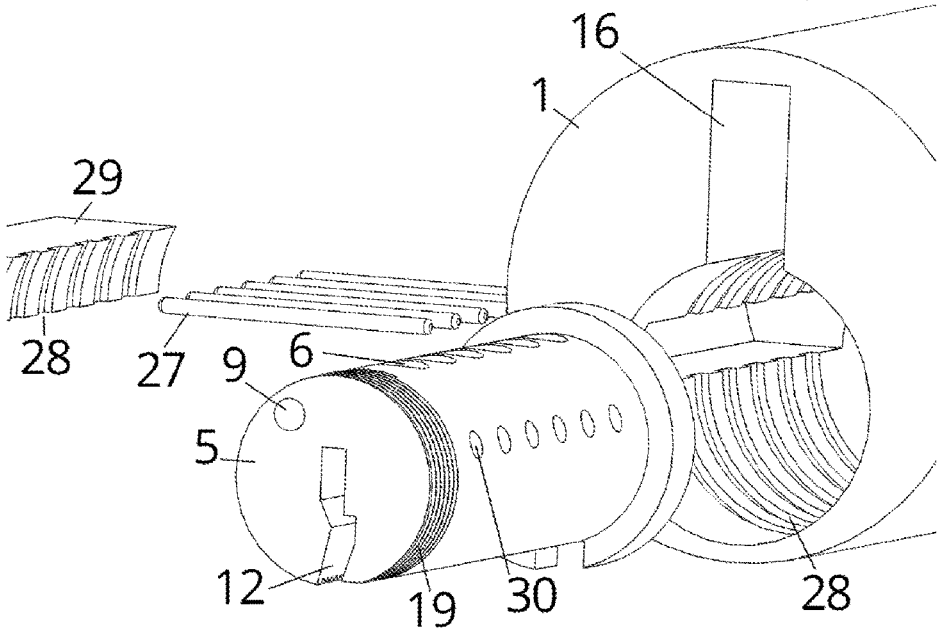
FIG. 10 is an enlarged exploded view of another portion of the lock in the embodiment shown in FIG. 8.

The binding of the driver pins 3 and the key pins 4 upon pushing the plug 5 can be accomplished in a number of ways, besides the axial pressure exerted by the expanding pin movement inhibitors 8 in expanding inhibitor apertures 7. In the alternative embodiment shown in FIGS. 8-11 (in which parts corresponding to those in the earlier embodiment are identified by the same number, unless otherwise stated), the binding is accomplished by the transverse action of one or more abutting pin movement inhibitors 27. Abutting pin movement inhibitors 27 are preferably relatively rigid, and are inserted into cylinder 1 through inhibitor apertures 30 at a suitable angle approximately transverse the axes of pin apertures 6, such that apertures 30 and pin apertures 6 meet at intersection 31 (shown only in FIG. 9). Preferably, the inhibitor apertures 30 do not intersect with the keyway 12, in order to avoid having the key collide with the abutting pin movement inhibitors 27.

Figure 11:
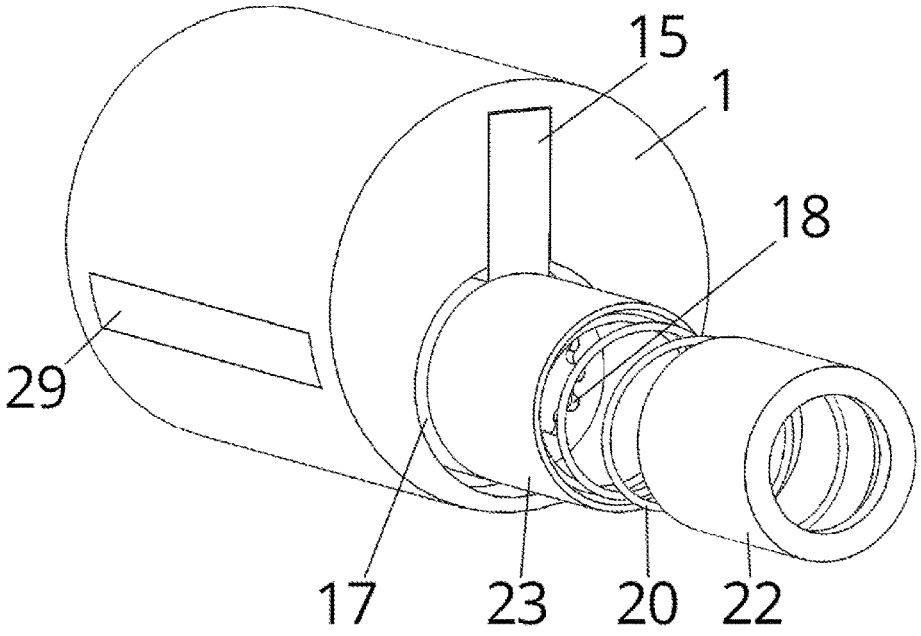
FIG. 11 is a perspective view of the rear of the embodiment of the lock shown in FIG. 8, in a first position in which rotational plug movement is restricted.

Cylinder 1 may be provided with a removable portion 29 which is replaced after assembly as illustrated in FIG. 11. Internally, cylinder 1 is provided with apertures, such as tracks 28, best seen in FIG. 10, corresponding to abutting pin movement inhibitors 27, although tracks 28 may outnumber abutting pin movement inhibitors 27. Both ends of the abutting pin movement inhibitors 27 are secured in tracks 28. Plug container 13 is similarly provided with container tracks 32, corresponding to abutting pin movement inhibitors 27, although again container tracks 32 may outnumber abutting pin movement inhibitors 27. The tracks 28 may run completely or partially around the circumference of the bore portion of recess 16, to allow for either full or partial rotation of the plug 5 and attached components, including the abutting pin movement inhibitors 27. The tracks 28 are preferably slightly wider than the abutting pin movement inhibitors 27, which allows just enough room for the plug to be pushed rearward to free plug rotation inhibitor 15 from recess 16, while also putting rearward pressure on the abutting pin movement inhibitors 27 toward the driver pins 3 and key pins 4, bringing them into contact with the pins 3, 4. The resulting contact between the abutting pin movement inhibitors and the face of the pins prevents the pins from moving, thereby preventing the shear gap 24 from aligning with the space between plug 5 and plug container 13, and preventing rotation of plug 5 unless the correct key has been inserted.

In the foregoing description, exemplary modes for carrying out the invention in terms of examples have been described. However, the scope of the claims should not be limited by those examples, but should be given the broadest interpretation consistent with the description as a whole. The specification and drawings are, accordingly, to be regarded in an illustrative rather than a restrictive sense.

The invention claimed is:

1. A pick-resistant pin tumbler lock comprising:

a cylinder;

a plug within said cylinder;

a plurality of pins extending between said cylinder and said plug;

at least one pin movement inhibitor, adapted to prevent movement of at least one of said pins by contacting a side of said at least one pin; and a plug rotation inhibitor adapted to prevent said plug from rotating within said cylinder, said plug rotation inhibitor being adapted to disengage from said cylinder by application of a rearward force on said plug;

wherein said at least one pin movement inhibitor comprises an elongated member, extending at least partially into said plug, and having a longitudinal axis parallel to a longitudinal axis of said plug; and wherein said plug rotation inhibitor does not disengage from said cylinder until said at least one pin is restricted by said at least one pin movement inhibitor.

2. The lock of claim 1 wherein said plug rotation inhibitor is engaged at least partially with said cylinder and prevents said plug from rotating within said cylinder unless said plug rotation inhibitor is disengaged from said cylinder.

3. The lock of claim 1 wherein said cylinder is insertable within a borehole and said plug rotation inhibitor is engaged at least partially with a recess in said borehole and prevents said plug from rotating within said cylinder unless said plug rotation inhibitor is disengaged from said recess.

4. The lock of claim 1 wherein said plug rotation inhibitor comprises an extension on a plug cap attached to a rear portion of said plug.

5. The lock of claim 4 wherein said plug cap is removably attached to said rear portion of said plug.

6. The lock of claim 5 further comprising a retainer pin on said rear portion of said plug, wherein said retainer pin engages with said plug cap to provide coordinated rotation of said plug cap and said plug.

7. The lock of claim 1 further comprising a plug container between said plug and said cylinder, wherein said plug container comprises apertures to accommodate said pins.

8. The lock of claim 1 further comprising a compression spring adapted to bias said plug rotation inhibitor towards said cylinder.

9. The lock of claim 8 further comprising at least one elongated member which extends into said plug under said rearward force, to axially compress and circumferentially expand said at least one pin movement inhibitor, and wherein said expansion causes said at least one pin movement inhibitor to contact said at least-one pin.

10. A pick-resistant pin tumbler lock comprising:

a cylinder;

a plug within said cylinder;

a plurality of pins extending between said cylinder and said plug;

at least one pin movement inhibitor, adapted to prevent movement of at least one of said pins by contacting a side of said at least one pin; and a plug rotation inhibitor adapted to prevent said plug from rotating within said cylinder;

wherein said at least one pin movement inhibitor comprises an elongated member, extending at least partially into said plug, and having a longitudinal axis parallel to a longitudinal axis of said plug; and wherein said elongated member axially compresses and circumferentially expands under a rearward force applied to said lock, and wherein said expansion causes said elongated member to contact said at least one pin.

11. A pick-resistant pin tumbler lock comprising:

a cylinder;

a plug within said cylinder;

a plurality of pins extending between said cylinder and said plug;

at least one pin movement inhibitor, adapted to contact and prevent movement of at least one of said pins; and a plug rotation inhibitor adapted to prevent said plug from rotating within said cylinder, said plug rotation inhibitor being adapted to disengage from said cylinder by application of a rearward force on said plug;

wherein said at least one pin movement inhibitor comprises a plurality of abutting pin movement inhibitors, each of which transversely contacts at least one of said pins when said rearward force is applied to said lock; and wherein said plug rotation inhibitor does not disengage from said cylinder until said at least one pin is restricted by said at least one pin movement inhibitor.

12. The lock of claim 11 wherein said plug comprises apertures through which said abutting pin movement inhibitors pass from said cylinder into contact with said pins.

13. A pick-resistant pin tumbler lock comprising:

a cylinder;

a plug container within said cylinder;

a plug within said plug container;

a plurality of pins extending between said plug container and said plug;

at least one pin movement inhibitor, adapted to prevent movement of at least one of said pins by contacting a side of said at least one pin; and a plug rotation inhibitor, adapted to prevent said plug from rotating within said plug container, said plug rotation inhibitor being adapted to disengage from said cylinder by application of a rearward force on said plug;

wherein said at least one pin movement inhibitor comprises an elongated member, extending at least partially into said plug, and having a longitudinal axis parallel to a longitudinal axis of said plug; and wherein said plug rotation inhibitor does not disengage from said cylinder until said at least one pin is restricted by said at least one pin movement inhibitor.

14. The lock of claim 13 wherein said plug rotation inhibitor is engaged at least partially with said cylinder and prevents said plug from rotating within said cylinder unless said plug rotation inhibitor is disengaged from said cylinder.

15. The lock of claim 13 wherein said cylinder is insertable within a borehole and said plug rotation inhibitor is engaged at least partially with a recess in said borehole and prevents said plug from rotating within said cylinder unless said plug rotation inhibitor is disengaged from said recess.

16. The lock of claim 13 wherein said plug rotation inhibitor comprises an extension on a plug cap attached to a rear portion of said plug.

17. The lock of claim 16 wherein said plug cap is removably attached to said rear portion of said plug.

18. The lock of claim 17 further comprising a retainer pin on said rear portion of said plug, wherein said retainer pin engages with said plug cap to provide coordinated rotation of said plug cap and said plug.

19. The lock of claim 13 further comprising a compression spring to bias said plug rotation inhibitor towards said cylinder.

20. The lock of claim 19 including a device which comprises at least one elongated member which extends into said plug under said rearward force, to axially compress and circumferentially expand said at least one pin movement inhibitor, and wherein said expansion causes said at least one pin movement inhibitor to contact said at least one pin.

21. A pick-resistant pin tumbler lock comprising:

a cylinder;

a plug container within said cylinder;

a plug within said plug container;

a plurality of pins extending between said plug container and said plug;

at least one pin movement inhibitor, adapted to prevent movement of at least one of said pins by contacting a side of said at least one pin; and a plug rotation inhibitor, adapted to prevent said plug from rotating within said plug container;

wherein said at least one pin movement inhibitor comprises an elongated member, extending at least partially into said plug, and having a longitudinal axis parallel to a longitudinal axis of said plug; and wherein said elongated member axially compresses and circumferentially expands under a rearward force applied to said lock, and wherein said expansion causes said elongated member to contact said at least one pin.

22. A pick-resistant pin tumbler lock comprising:

a cylinder;

a plug container within said cylinder;

a plug within said plug container;

a plurality of pins extending between said plug container and said plug;

at least one pin movement inhibitor, adapted to contact and prevent movement of at least one of said pins; and a plug rotation inhibitor, adapted to prevent said plug from rotating within said plug container, said plug rotation inhibitor being adapted to disengage from said cylinder by application of a rearward force on said plug;

wherein said at least one pin movement inhibitor comprises a plurality of abutting pin movement inhibitors, each of which transversely contacts at least one of said pins when said rearward force is applied to said lock; and wherein said plug rotation inhibitor does not disengage from said cylinder until said at least one pin is restricted by said at least one pin movement inhibitor.

23. The lock of claim 22 wherein said plug comprises apertures through which said abutting pin movement inhibitors pass from said cylinder into contact with said pins.

* * * * *